US005387051A

United States Patent [19]

Valente

[11] Patent Number: 5,387,051

[45] Date of Patent: Feb. 7, 1995

[54] LEVELLED CEMENT SPREADER FOR LAYING TILES

[75] Inventor: Pietro Valente, Windsor, Canada

[73] Assignee: Antonietta Investments Ltd., Windsor, Canada

[21] Appl. No.: 41,990

[22] Filed: Apr. 2, 1993

[30] Foreign Application Priority Data

Apr. 15, 1992 [CA] Canada ..... 2066089

[51] Int. Cl.[6] ..... E01C 19/43

[52] U.S. Cl. ..... 404/84.05; 404/84.1; 404/84.5; 404/93; 404/101; 404/108; 404/110; 52/389

[58] Field of Search ..... 404/101, 103, 110, 118; 52/749, 747; 366/32, 65

[56] References Cited

U.S. PATENT DOCUMENTS

| | | | |
|---|---|---|---|
| Re. 23,165 | 11/1949 | Little | 366/32 |
| 1,941,404 | 12/1933 | Lansing | 33/410 |
| 2,092,694 | 3/1935 | Crooks | 52/747 |
| 2,466,919 | 4/1949 | Sykes | 33/526 |
| 2,930,135 | 3/1960 | Rodtz | 33/518 |
| 3,199,205 | 8/1965 | Halde et al. | 33/526 |
| 3,213,769 | 10/1965 | Smith | 404/110 |
| 3,230,845 | 1/1966 | Mauldin | 404/110 |
| 3,254,417 | 6/1966 | Carmichael | 33/526 |
| 3,373,669 | 3/1968 | Schmitz | 404/110 |
| 3,463,062 | 8/1969 | Ehrbar et al. | 404/84.05 |
| 3,605,579 | 9/1971 | Heltzel | 404/93 |
| 3,675,545 | 7/1972 | Anderson et al. | 404/105 |
| 3,678,645 | 7/1972 | Valdes | 52/749 |
| 3,703,857 | 11/1972 | MacKinnon | 404/93 |
| 3,775,856 | 12/1973 | Schmidt | 33/180 R |
| 4,194,853 | 3/1980 | Barth et al. | 404/73 |
| 4,310,293 | 1/1982 | Eggleton | 404/110 |
| 4,345,852 | 8/1982 | Goto et al. | 404/114 |
| 4,614,486 | 9/1986 | Bragagnini | 404/103 |
| 4,718,173 | 1/1988 | Eklund | 33/533 |
| 4,891,888 | 1/1990 | Maria De Bree et al. | 33/293 |
| 4,893,451 | 1/1990 | Valente | 52/749 |
| 4,978,246 | 12/1990 | Quenzi et al. | 404/84.5 |
| 5,129,803 | 7/1992 | Nomura et al. | 404/84.05 |

*Primary Examiner*—Ramon S. Britts
*Assistant Examiner*—Pamela Anne O'Connor
*Attorney, Agent, or Firm*—Jacobson, Price, Holman & Stern

[57] ABSTRACT

The present invention relates to an apparatus for applying cementitious material onto a floor surface while screeding it and producing varying depths of ridged impressions in a longitudinal direction within the cementitious material, from deep ridges to flat surfaced material, all formed with a levelled surface, adapted to receive tile components and other flooring products. The apparatus includes a base adapted for displacement on the floor surface and provided with a container to receive the cementitious material. The container is adapted to discharge a required amount of cementitious material on the floor surface. The base defines an opening which screeds the material onto the floor surface and trails the discharged cementitious material from the container on the floor surface when the apparatus is operatively displaced. A gate is moveably mounted to be vertically displaced for selectively reducing the opening and for evenly spreading the cementitious material passing therethrough. A plurality of spring loaded fingers mounted onto the front of the base are biased to abut onto the floor surface and are adapted to scrapingly remove levelled discharged cementitious material in operation of the apparatus for forming spaced apart channels substantially free of cementitious material or varying in depth up to a flat surface.

14 Claims, 3 Drawing Sheets

LEVELLED CEMENT SPREADER FOR LAYING TILES

BACKGROUND OF THE INVENTION

1. Field of the Invention

This invention relates to an apparatus for levelled cementitious material spreading prior to laying tiles or other flooring materials, or to produce a level floor surface. More particularly, the invention relates to an apparatus for cementitious material spreading onto a floor surface with irregularities which results in an improved consistency of bonding of the cementitious material to the floor surface and a near perfect levelled adhesive surface for laying tiles or other flooring materials, or to produce a level floor surface.

2. Description of the Prior Art

It is well known that it is often difficult to install tiles or the like on a floor surface because this surface is often uneven. The floor surface is first covered with an adhesive material such as a cementitious material preferably with a trowel so that rows of adhesive material are produced to varying depths ranging from channels that are substantially free of material to a flat surface. The rows of adhesive material provide for a surface on which tiles and the like are pressed in to varying depths depending on the thickness of each tile or the like and upon the deviation from level of the floor surface under the adhesive material, all to effect a flat and level surface of tiles or the like. The usual bed of cementitious material has to be applied in such a manner as to compensate for irregularities on the floor surface to provide for a levelled finished floor surface. In the case of highly uneven floor surfaces, no matter what care is being taken to cover the floor surface with the adhesive material, it is nearly impossible to achieve near perfect levelling of the adhesive surface.

The U.S. Pat. No 3,678,645 issued on Jul. 25, 1972 in the name of Valdes, discloses a tile placing machine for arranging tiles to be placed on floor and wall surfaces in rows and columns with the individual tiles being spaced from one another. This tile placing machine includes means for levelling the tiles so as to place them in coplanar relationship with respect to each other to a bed of cementitious material in an effective and rapid manner. This device only lays tiles onto a usual bed of adhesive material which had been applied by hand. Again, this device does not provide a near perfect levelled adhesive surface for laying tiles.

SUMMARY OF THE INVENTION

One aim of the present invention is to provide for an apparatus for levelled cementitious material spreading before laying tiles or the like, or to produce a levelled floor surface.

Another aim of the present invention is to provide for an apparatus for near perfect adhesive spreading onto an uneven floor.

Another aim of the present invention is to provide for an apparatus which enables an unskilled laborer to levelly spread cementitious material onto an uneven surface with high efficiency.

In accordance with the present invention, there is provided an apparatus for producing onto a floor surface a level surface of a cementitious material adapted to receive tile components or the like, comprising a base adapted for displacement on the floor surface and provided with a container adapted to receive the cementitious material; discharging means adapted to discharge a required amount of cementitious material from the container on the floor surface; the base defining an opening which trails the discharged cementitious material from the container on the floor surface when the apparatus is operatively displaced and means for varying the size of the opening for evenly spreading the cementitious material passing therethrough; thereby establishing a levelled surface of cementitious material that is in direct relation to an establish reference point.

In accordance with a preferred embodiment of the present invention, the apparatus additionally comprises means trailing the opening for forming in the substantially evenly spread cementitious material a plurality of spaced apart parallel channels substantially free of cementitious material varying in depth up to a flat surface of cementitious material, thereby producing a plurality of parallel elongated ridges defining substantially coplanar upper tile-receiving or the like surfaces.

In accordance with a preferred embodiment of the present invention, the discharging means comprises the container being provided with a bottom surface having an opening extending therethrough and being adapted to discharge cementitious material; and means to selectively close the opening of the container.

In accordance with another embodiment of the present invention, means to selectively close the opening comprises the container having a rear wall and an extension of the rear wall pivotally mounted onto the container rear wall and connected to actuating means.

In accordance with another embodiment of the present invention, the container having side walls and the actuating means are pivotable levers mounted onto the container side walls and being fixedly connected to each ends of the extension for pivotally displacing the extension.

According to another embodiment of the present invention, the apparatus additionally comprises cementitious material vibrating means provided onto the container and adapted to shake the cementitious material onto the floor surface.

According to another preferred embodiment of the present invention, the means trailing the opening for forming a plurality of spaced apart channels varying from being substantially free of cementitious material, up to a flat surface, comprises a plurality of spring loaded fingers mounted onto the front of the base and being biased to abut onto the floor surface and adapted to scrapingly remove levelled discharged cementitious material in operation of the apparatus.

In accordance with another embodiment of the present invention, the opening defined by the base comprises the base having a front wall vertically spaced from the floor surface; the means for varying the size of the opening of the front wall of the base comprises a gate moveably mounted to be vertically displaced for selectively reducing the opening; control means for vertical displacement of the gate; and sensor means for monitoring the vertical distance of the gate from the floor surface and actuating the control means.

According to a further preferred embodiment of the invention, the sensor means comprises a substantially horizontal extension having one end pivotally mounted onto the base and being provided at the other with a wheel, the wheel being adjacent to the base; and means for monitoring the angular variations of the extension.

According to another preferred embodiment of the present invention, the container is removably mounted on the base and comprises locking means for selectively locking the container onto the base.

According to another preferred embodiment of the present invention, the apparatus further comprises a wheel connected onto the base for supporting the base in front of the discharge of cementitious material when the apparatus is displaced in the direction of operation and adapted to move the base; and means for vertically adjusting the wheel for supporting more or less the base.

According to another embodiment of the present invention, the apparatus additionally comprises a motive means to move the apparatus in the direction of operation which is adapted to be automatically actuated.

According to another preferred embodiment of the invention, the sensor means comprises a substantially horizontal extension having one end mounted onto the base and being provided at the other end with a laser beam having its light emitted towards the floor surface adjacent to the base or towards as reference point at some distance from the apparatus; and means for monitoring the variations in the vertical distance between the extension and the floor surface.

BRIEF DESCRIPTION OF THE DRAWINGS

The invention will now be illustrated by means of the annexed drawings which are given only by way of illustration and in which.

DETAILED DESCRIPTION OF THE INVENTION

Figure 1:
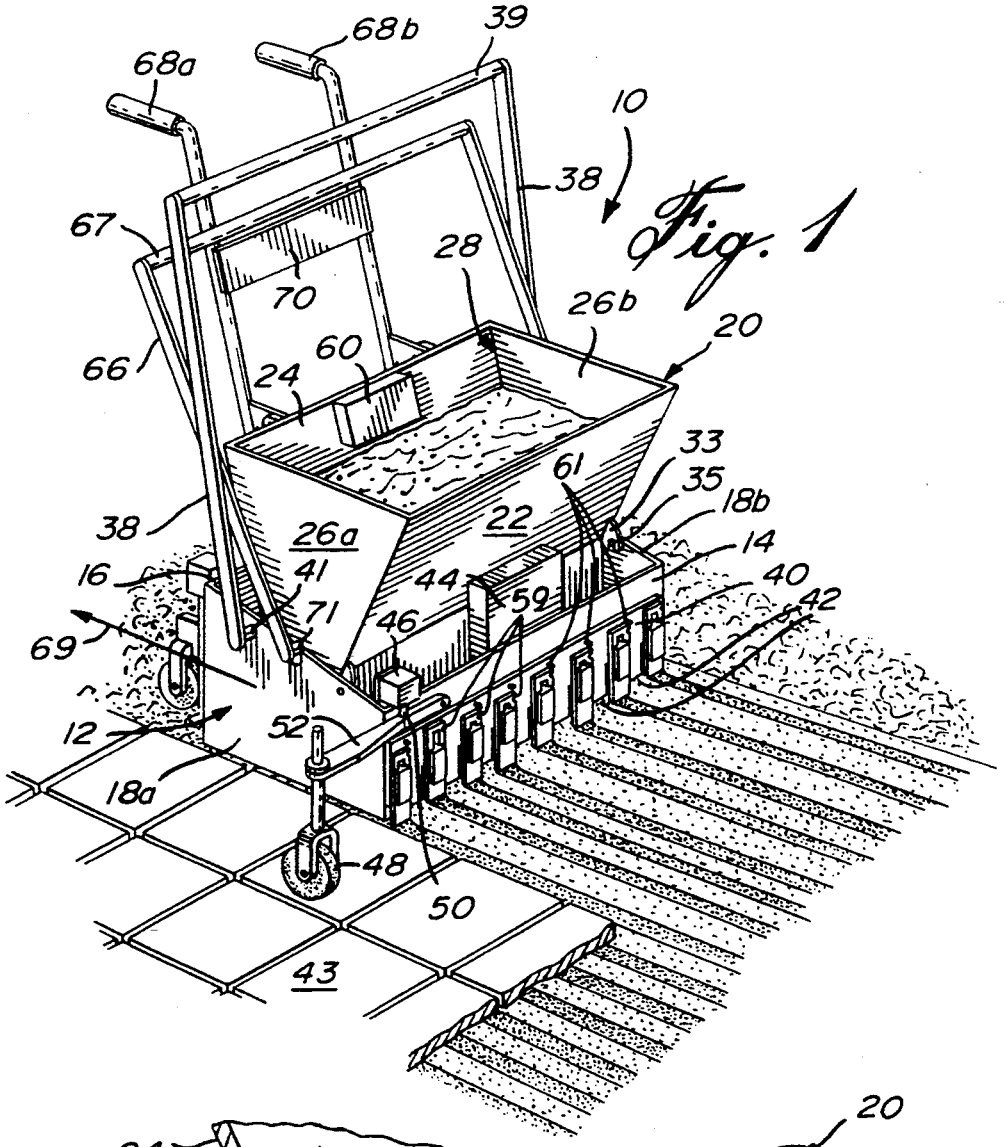
FIG. 1 is a perspective view of the cementitious spreader apparatus in accordance with a first embodiment of the present invention, in a typical operation.

Referring now to the drawings, it will be seen that the levelled cementitious material spreader apparatus according to one embodiment of the present invention is generally denoted 10.

The levelled cementitious material spreader apparatus 10 consists of a base 12 which has front 14, rear 16 and side walls 18*a* and 18*b*. The upper edge of the front wall 14 is lower than that of the rear wall 16 and the side walls 18*a* and 18*b* are angled from the higher rear wall 16 to the lower front wall 14.

A container 20 which is mounted onto the base 12 consists of front 22, rear 24 and side walls 26*a* and 26*b* and defines a top opening 28 to receive the cementitious material.

Figure 2:
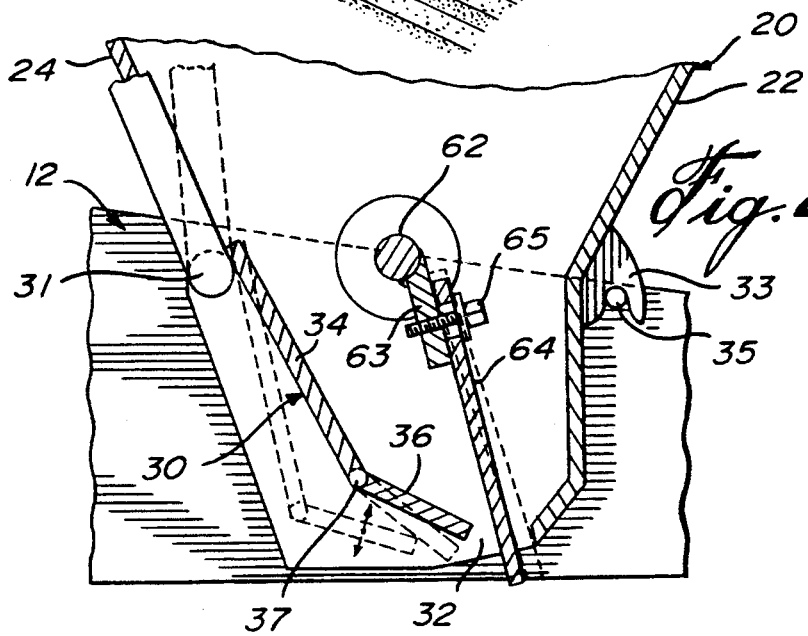
FIG. 2 is a fragmentary cross-sectional side view of the first embodiment.
Figure 3:
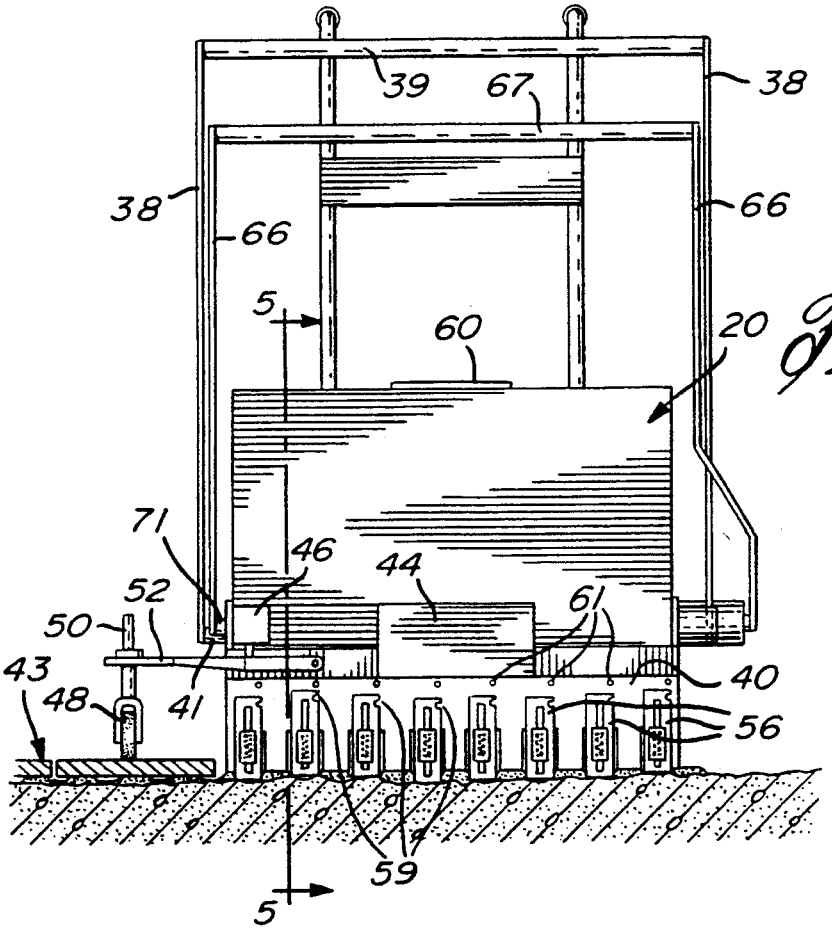
FIG. 3 is a front elevation view of the cementitious material spreader apparatus of the first embodiment in a typical operation.

Referring now to FIG. 2, the rear wall 24 of the container 20 has an extension 30 pivotably mounted at a pivot point 31 which is located below the upper edge of the sidewalls 18*a*, 18*b* and the angular position of which determines the size of a bottom opening 32 through which the cementitious material is discharged onto the floor surface. The extension 30 consists of a first portion 34 and a second portion 36 pivotally connected at a pivot point 37 where they define an angle between 90° to 180°. The extension 30 is displaced by a lever 38 which has a stub shaft 41 extending through the side walls 18*a*, 18*b* of the base 12 and through the side walls 26*a*, 26*b* of the container 20 to be fixedly connected at the pivot point 31 to the extension 30. The pivot of the lever 38 by way of a handle portion 39 causes the extension 30 to move and hence to enlarge or reduce the size of the bottom opening 32 of the container 20, thereby discharging more or less cementitious material onto the floor surface.

The container 20 has brackets 33 locking with notch 35 on the base 12 and which enables replacement or removal of the container 20.

The rear 16 and side walls 18*a*, 18*b* of the base 12 contact the floor surface while the front wall 14 which is vertically spaced from the floor surface defines an opening (not shown) which allows for discharged cementitious material to go through. A gate 40 is moveably mounted onto the front wall 14 of the base 12 and defines an opening 42. The cementitious material which has been discharged onto the floor is levelled by the movement of the gate 40 as it goes through the opening 42 defined by the gate 40. The gate 40 is levelled above the floor surface by a control box 44 which displaces the gate 40 parallel in a substantially vertical plane perpendicular to the plane of the tile-covered floor surface 43. The control box 44 may be electrical and includes battery and the like (not shown). The control box 44 is actuated by a monitor box 46. Referring to FIG. 1, a wheel 48 is moveably mounted at one end of an horizontal extension 52 which has its other end pivotally mounted to the front wall 14 of the base 12 and abutting a retractable pin 50 of the monitor box 46. The wheel 48 rolls adjacent to the side wall 18*a* of the base 12 on a tile-covered floor surface 43 or a surface which is otherwise covered and the relative pivot of the extension 52 is evaluated by the monitor box 46, which accordingly actuates the control box 44 which acts on the gate 40.

When the vertical position of the extension 52 varies, the retractable pin 50 is vertically displaced. The monitor box 46 analyses the displacement and accordingly actuates the control box 44 to move the gate 40 closer or farther from the floor surface to provide levelled adhesive surface.

Figure 6:
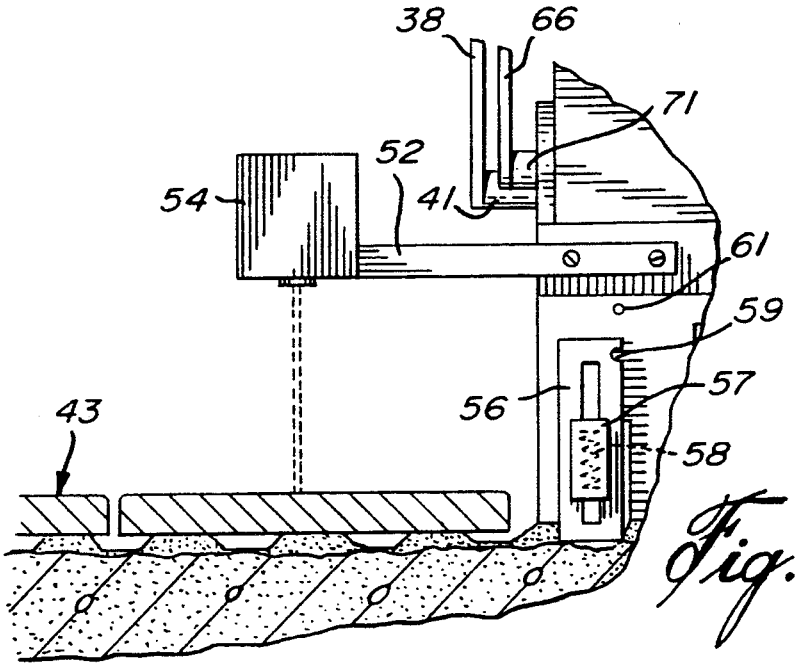
FIG. 6 is a front elevation view of a section of a cementitious material spreader apparatus in accordance with a second embodiment of the present invention.

The wheel 48 as shown in FIG. 1 can be replaced by a laser beam 54 as shown in FIG. 6. The laser beam 54 has its light emitted toward the floor surface and is fixedly mounted onto the extension 52. Or, the laser beam 54 has its light emitted toward a reference point some distance from the apparatus 10. The monitor box 46 evaluate the variation in the vertical distance between the extension 52 and the tile-covered floor surface 43 for actuating the control box 44.

A plurality of spaced apart spring loaded vertical fingers 56 are mounted onto the gate 40. The spring loaded fingers 56 being slidably mounted on a guide 57 fixedly mounted to the gate 40 and the fingers 56 are biased to abut the floor surface by a spring 58. The fingers 56 follow the irregularities of the floor surface and scrapingly remove level discharged cementitious material which results in levelled ridges of cementitious material; or, the fingers 56 may be locked into a vertical position by the notch 59 being engaged in the pin 61 on the gate 40 so that the resulting levelled cementitious material has no ridges.

A vibrator 60 is provided on the rear wall 24 of the container 20 and ease the discharging of the cementitious material through the opening 32 of the container 20 by continuously shaking the container 20. The vibrator 60 further provides a continuous mixing of the liquid components of the cementitious material in the container 20.

Now referring to FIG. 2, a shaft 62 has each ends rotatably mounted to the side walls 26*a*, 26*b* of the container 20. A screeding blade 64 is adjustably mounted to an extension 63 of the shaft 62 by a screw 65. The screeding blade 64 extends through the bottom opening 32 of the container 20 and is adjusted to abut the floor surface. The vibrator 60 vibrates the screeding blade 64 to entrap and incorporate particles of dust on the floor surface into the cementitious material creating what is commonly referred to as a screed, thereby providing a better bond to the floor surface. This mixing of the discharged cementitious material with the dust on the floor results in a better adhesion of the cementitious material on the floor surface. The screeding blade 64 is pivoted by a lever 66 which has a stub shaft 71 extending through the side walls 18*a*, 18*b* of the base 12 and through the side walls 26*a*, 26*b* of the container 20 and being fixedly connected to the shaft 62. The lever 66 is provided with a handle portion 67 to displace the lever 66 causing the screeding blade 64 to be pivoted. Depending on the amount of dust on the floor surface, the screeding blade 64 is positioned to allow for a proper mixture of the dust and cementitious material.

A pair of handles 68*a*, 68*b* are connected to each other by a horizontal reinforcement extension 70. The handles 68*a*, 68*b* are fixedly connected to the rear wall 16 of the base 12 and assist the worker in pulling the cementitious spreader apparatus in operation in the direction indicated by arrow 69 in FIG. 1 and FIG. 5.

Figure 5:
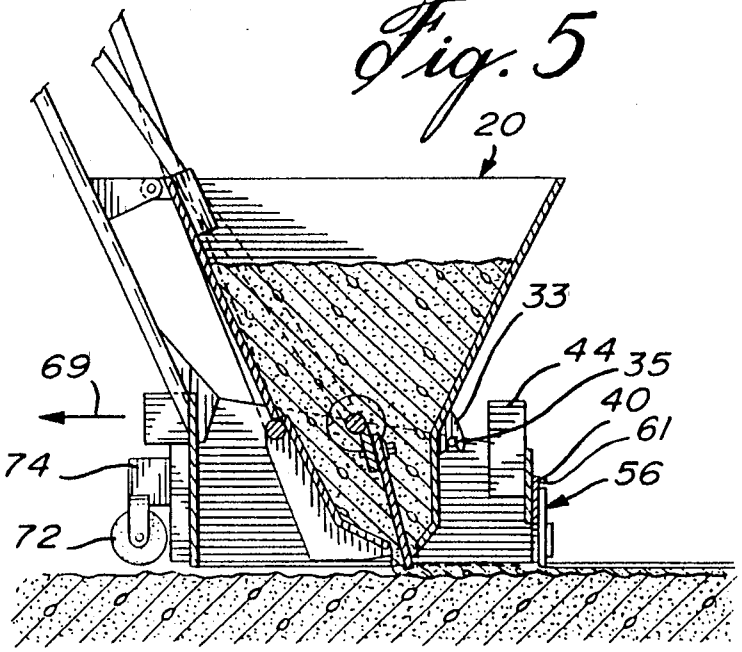
FIG. 5 is a cross-sectional view of a cementitious material spreader apparatus in accordance with the first embodiment of the present invention taken along line 5—5 of FIG. 3, in a typical operation.

The cementitious material spreader apparatus 10 in a typical operation as shown in FIG. 1 and FIG. 5 has a quantity of cementitious material in the container 20. The cementitious material is shaken by the vibrator 60, the screeding blade 64 is adjusted to abut the floor surface and the lever 38 is moved to allow cementitious material through the bottom opening 32 of the container 20 onto the floor surface. The apparatus 10 is pulled by the handles 68*a*, 68*b* in a direction 69 as the discharged cementitious material is levelled by the gate 40 and is formed into ridges by the spring loaded fingers 46, which results in a near perfect levelled surface ready for laying tiles and the like. A proper vertical position of the gate 40 is ensured by the wheel 48 or laser beam 54 cooperating with the monitor box 46 and the control box 44 to obtain levelled surface throughout.

It will be realized that cementitious material spreading in accordance with the apparatus of the present invention can be carried out by an untrained laborer at very low cost while achieving a perfect adhesive surface for laying tiles and the like.

Figure 4:
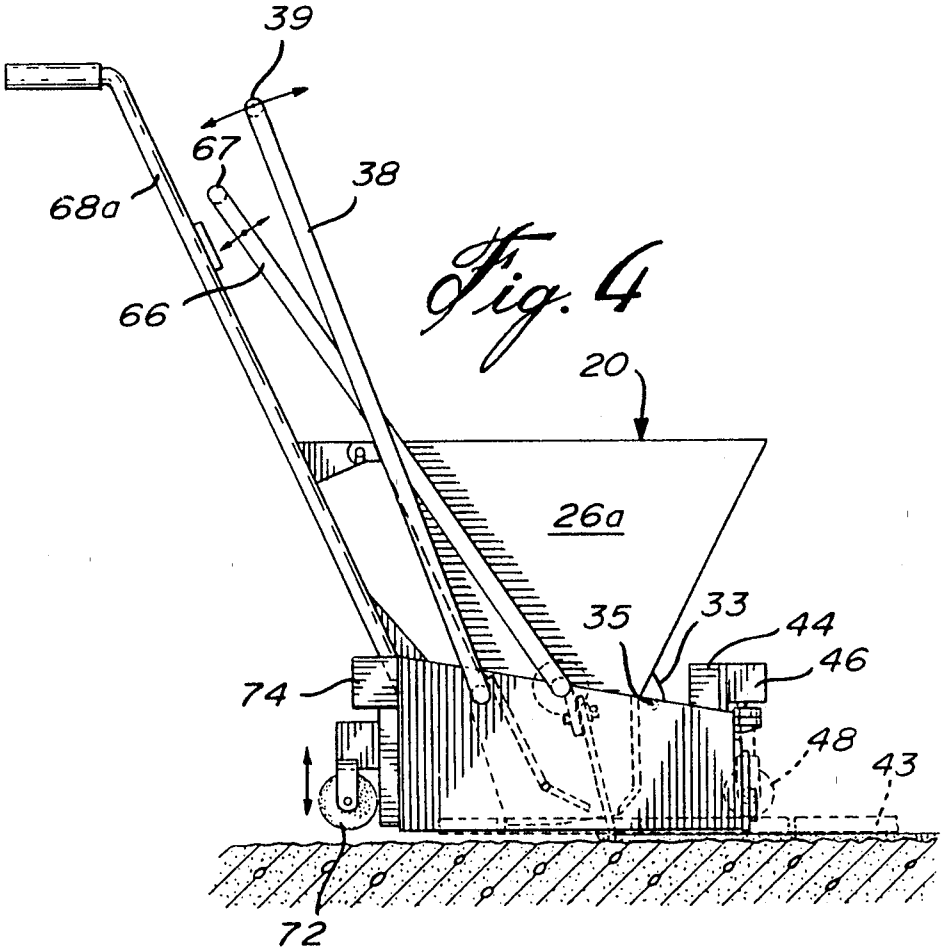
FIG. 4 is a side elevation view of the cementitious material spreader apparatus in accordance with the first embodiment of the present invention.

Referring now to FIG. 4, a wheel 72 provided on the rear wall 16 of the base 12 is movable along a substantially vertical axis by a wheel adjustment box 74 for supporting more or less the base 12. When the wheel 72 is lowered onto the floor surface, the base 12 at the rear end thereof is supported for the transport of the apparatus 10.

The apparatus can be provided with an automatically actuated motive device to move the apparatus in the direction of operation.

While the invention has been described with particular reference to the illustrated embodiment, it will be understood that numerous modifications thereto will appear to those skilled in the art. Accordingly, the above description and accompanying drawings should be taken as illustrative of the invention and not in a limiting sense.

I claim:

1. An apparatus for producing onto a floor surface, a level surface of a cementitious material comprising:

a base adapted for displacement on the floor surface, and a container surmounting said base and resting thereon, and adapted to receive the cementitious material, said container having a front wall, a rear wall and a bottom opening, said rear wall including a downward extension which is pivotally mounted on said rear wall, means for causing pivoting of said downward extension to thereby enlarge or reduce the size of the bottom opening of said container and vary the amount of cementitious material discharged from said container into said base depending on required amounts thereof, said base having an opening which trails the discharged cementitious material from said container on the floor surface when said apparatus is operatively displaced, said base opening being defined by a front wall of said base which is vertically spaced from the floor surface, a gate movably mounted on said base front wall to be vertically displaced for selectively enlarging or reducing said opening, sensor means detecting irregularities in said floor surface, and control means responsive to said sensor means enabling to move said gate for spreading the cementitious material passing therethrough to produce said level surface.

2. An apparatus in accordance with claim 1, further comprising:

means trailing said opening for forming in the substantially evenly spread cementitious material a plurality of spaced apart parallel channels substantially free of cementitious material, thereby producing a plurality of parallel elongated ridges defining substantially coplanar horizontal upper tile-receiving surfaces varying in depth up to a flat surface.

3. An apparatus in accordance with claim 1 which comprises pivotable levers mounted onto said container side walls and being fixedly connected to each ends of said extension for pivotally displacing said extension.

4. An apparatus in accordance with claim 3, further comprising cementitious material vibrating means provided onto said container and adapted to shake said cementitious material.

5. An apparatus in accordance with claim 2, wherein said means trailing said opening for forming a plurality of spaced apart channels substantially free of cementitious material varying in depth up to a flat surface comprising a plurality of spring loaded fingers mounted onto said gate and being biased to abut onto the floor surface and adapted to scrapingly remove levelled discharged cementitious material in operation of the apparatus.

6. An apparatus in accordance with claim 1, wherein said sensor means comprising:

a substantially horizontal extension having one end pivotally mounted onto said base and being provided at the other with a wheel, said wheel being adjacent said base; and means for monitoring the angular variations of said extension.

7. An apparatus in accordance with claim 1, wherein said sensor means comprising:

a substantially horizontal extension having one end mounted onto said base and being provided at the other end with a laser beam having its light emitted towards the floor surface adjacent to said base, or towards a reference point at some distance from the apparatus; and means for monitoring the variations in the vertical distance between said extension and the floor surface.

8. An apparatus in accordance with claim 4, further comprising:

a shaft having each end mounted onto said side walls of said container;

a vertically adjustable blade being mounted onto said shaft and extending therethrough said opening of said container and adapted to be adjusted to abut against the floor surface and mixing dust with discharged cementitious material when said apparatus is operatively displaced.

9. An apparatus in accordance with claim 1, wherein said container is removably mounted on said base and comprising locking means for selectively locking said container onto said base.

10. An apparatus in accordance with claim 1 further comprising wheel connected onto said base for supporting said base in front of the discharge of cementitious material when said apparatus is displaced in the direction of operation and adapted to move said base.

11. An apparatus in accordance with claim 10, further comprising handle means mounted onto said base.

12. An apparatus in accordance with claim 10, further comprising means for vertically adjusting the wheel for supporting more or less said base.

13. An apparatus in accordance with claim 12, wherein said means for vertically adjusting the wheel is adjusted for supporting said base in transport of said apparatus.

14. An apparatus in accordance with claim 10, further comprising motive means to move the apparatus in the direction of operation which is adapted to be automatically actuated.

* * * * *